US007517413B2

(12) United States Patent
van Buskirk et al.

(10) Patent No.: US 7,517,413 B2
(45) Date of Patent: Apr. 14, 2009

(54) REMEDIATION OF MICROFLORAL AND BIOFILM DEVELOPMENT FROM LAUNDERING DEVICES

(75) Inventors: Gregory van Buskirk, Danville, CA (US); Scott D. Manske, Charlotte, NC (US); Steven Bromberg, Livermore, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 12/054,650

(22) Filed: Mar. 25, 2008

(65) Prior Publication Data

US 2008/0261840 A1 Oct. 23, 2008

Related U.S. Application Data

(60) Provisional application No. 60/908,128, filed on Mar. 26, 2007.

(51) Int. Cl.
*B08B 3/00* (2006.01)

(52) U.S. Cl. ..... 134/30; 510/302; 510/380; 510/466

(58) Field of Classification Search ..... 510/380, 510/302, 466; 134/30
See application file for complete search history.

(56) References Cited

U.S. PATENT DOCUMENTS 3,568,233 A * 3/1971 Terzian ..... 15/105
2002/0189647 A1 * 12/2002 Labib et al. ..... 134/22.12
2002/0193270 A1 * 12/2002 Cermenati et al. ..... 510/302
2003/0021853 A1 * 1/2003 Wei et al. ..... 424/616
2003/0083222 A1 * 5/2003 Raso et al. ..... 510/463
2003/0096722 A1 * 5/2003 Caselli et al. ..... 510/382
2003/0228988 A1 * 12/2003 Kloo et al. ..... 510/161
2004/0077519 A1 * 4/2004 Price et al. ..... 510/499
2004/0194810 A1 * 10/2004 Strothoff et al. ..... 134/25.2
2005/0028845 A1 * 2/2005 Labib et al. ..... 134/102.2
2005/0126599 A1 * 6/2005 Labib et al. ..... 134/22.11
2005/0187321 A1 * 8/2005 Verrall et al. ..... 524/236
2006/0094615 A1 * 5/2006 Hecht et al. ..... 510/179
2007/0105112 A1 * 5/2007 Hitchman et al. ..... 435/6
2008/0092928 A1 * 4/2008 Wong et al. ..... 134/30
2008/0261840 A1 * 10/2008 van Buskirk et al. ..... 510/109

FOREIGN PATENT DOCUMENTS

JP 2005-075873 3/2005

* cited by examiner

*Primary Examiner*—Mark Eashoo
*Assistant Examiner*—Mohammad R Asdjodi
(74) *Attorney, Agent, or Firm*—Alok Goel

(57) ABSTRACT

Methods, improved compositions and kits are employed that provide dosing and cleaning solutions containing a halogen-based oxidant effectively delivered to remediate microfloral and biofilm development on the laundering surfaces of enclosed horizontal axis washers. The improved compositions, and the methods and kits employing them, provide for effective remediation while minimizing and/or preventing detrimental effects upon halogen-susceptible surfaces of the laundering devices, including reduced corrosion and biofilm on interior metal and laundering surfaces.

12 Claims, 1 Drawing Sheet

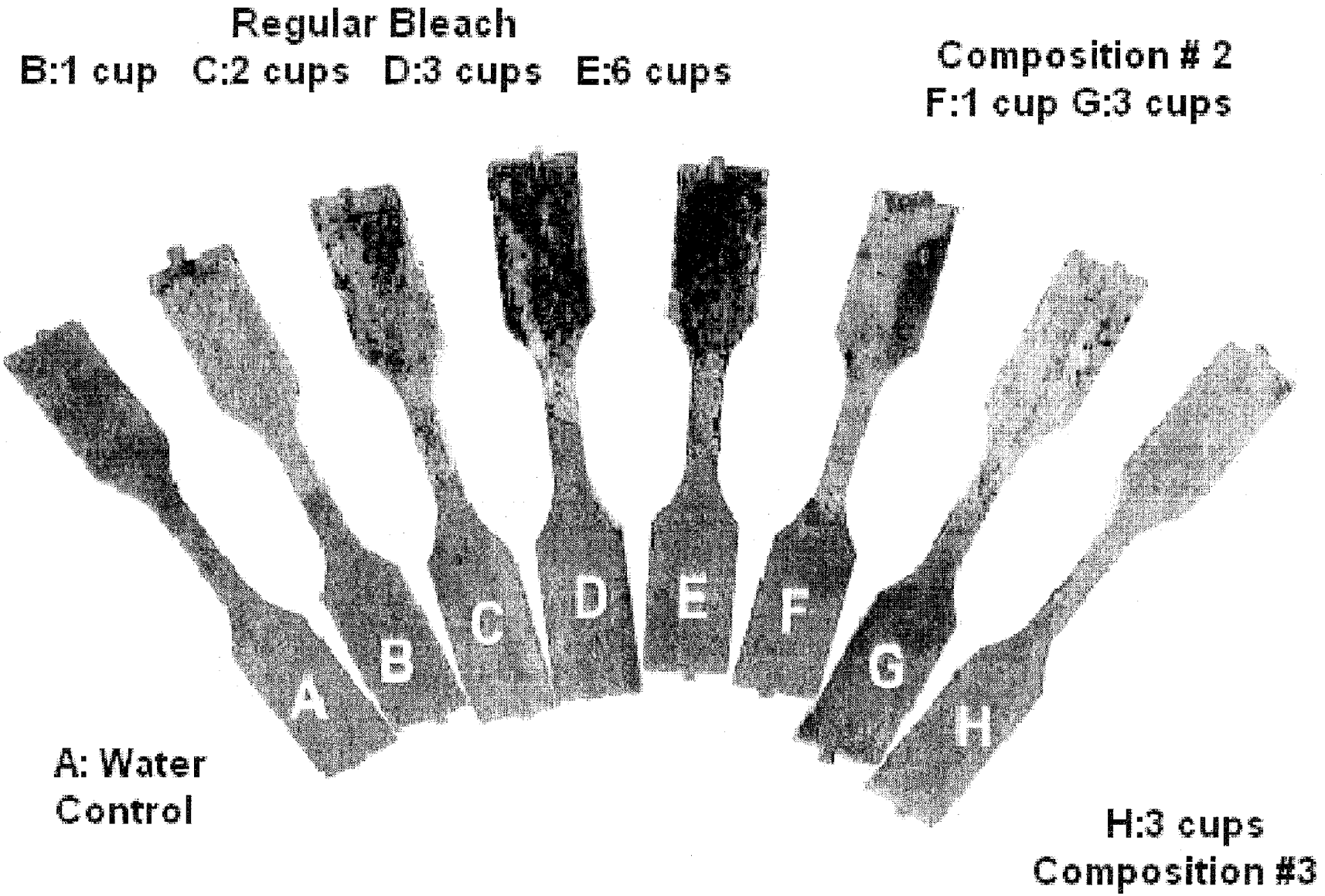
Regular Bleach
B:1 cup C:2 cups D:3 cups E:6 cups
Composition # 2
F:1 cup G:3 cups
H:3 cups
Composition #3
A: Water
Control
A
B
C
D
E
F
G
H

REMEDIATION OF MICROFLORAL AND BIOFILM DEVELOPMENT FROM LAUNDERING DEVICES

CROSS-REFERENCE TO EARLIER FILED APPLICATIONS

The present application claims the priority of U.S. Provisional Application Ser. No. 60/908,128 filed Mar. 26, 2007, the entire disclosure of which is hereby incorporated by reference.

BACKGROUND OF THE INVENTION

1. Field of the Invention

This invention relates generally to methods, improved compositions and kits to remediate microfloral and biofilm development on the laundering surfaces of horizontal axis washers which provide a sealed high humidity environment between uses that promulgate the formation, survival and transfer of microbial contaminants within the washer and to treated textile items.

2. Description of the Related Art

Transfer of pathogenic organisms in the laundering process has been documented in the academic and commercial literature. Organisms such as fecal coliforms normally survive the laundering process, in spite of rigorous washing and drying conditions, creating a pathway for the persistence and propagation of this process is the formation of biofilm of the pathogens. Biofilms are a tenacious film of polysaccharides excreted by the pathogens, which form a protective covering to shield the microbes from environmental forces. This film is difficult to remove without mechanical action and/or through the use of aggressive chemicals.

Some users of so-called "High Efficiency" (he) washers have observed that this new class of machines is especially prone to development of biofilm. These machines have been on the market since the mid-1990's; in the last five years the growth of this class has exacerbated a problem which may have always been present, but under-appreciated due to lack of penetration. As numbers of such machines increased on the market, reports increased of musty odors indicative of microbial colonization within the machines. It is possible that a confluence of laundry factors has been responsible for rapid development of this problem: 1. Virtual elimination of phosphates from detergents (which had been widely used until the early 1990s). These agents were very effective at cleaning surfaces, which probably minimized the chances for biofilm development; 2. Gradual, but increasing, lowering of wash temperatures, and 3) Lack of use of sodium hypochlorite bleach in a weekly routine, due in part to reduced wearing of white garments and consumer fears of using this and similar halogen based bleaches in their laundry.

HE washing machine manufacturers have attempted to address this problem to eliminate the biofilms, which they have observed building up on components that are difficult to access for vigorous cleaning, such as the back of the wash drum, and internal pump parts, channels and tubing. The proliferation of pathogens is especially alarming when one understands the nature of the pathogens found in such environments, which may include mold and mildew spores, pathogenic gram negative and gram positive bacteria, and fungus.

Washing machine manufacturers have a recommended approach and method of alleviating the biofilm through introducing approximately three cups of regular household bleach into an empty (non-detergent, no clothes) washload, which is in effect equal to an exposure exceeding about 2500 ppm sodium hypochlorite. While very effective at removing the biofilm, this treatment would potentially lead to corrosion of the metallic parts of the washer after repeating usage, specifically at the weld junctions of the stainless steel portions, as well as the aluminum/copper alloy agitator and parts constructed of susceptible metal alloys and plastics, particularly nylon bushings, bumpers and seals, because commercially available hypochlorite bleaches have no corrosion inhibiting materials present.

Accordingly, there is a need for improved processes and materials for remediation of microfloral and biofilm development on the laundering surfaces of horizontal axis washers to prevent the formation, survival and transfer of microbial contaminants within the washer, which are effective without causing corrosion and degradation of susceptible parts and materials employed in the construction of the machines, and which further provide a convenient and easy to use treatment option for users to address these problems.

SUMMARY OF THE INVENTION

In accordance with one aspect of the present invention is provided a process for remediation of microfloral propagation and biofilm development on internal laundering surfaces of a washing machine that are oxidatively sensitive, comprising the steps of: (a) exposing the laundering surfaces, in the absence of fabric and detergent, to a cleaning solution comprising: (i) a halogen-based oxidant at a level between about 200 to 2500 ppm; (ii) an effective level of an alkaline builder selected from the group consisting of silicates, phosphates, carbonates, and mixtures thereof; wherein said effective level of said alkaline builder is that amount capable of reducing the effects of corrosion of said halogen-based oxidant on said laundering surfaces; and (iii) less than 200 ppm of a halogen stable surfactant; wherein step (a) provides a contact duration of the cleaning solution with said laundry surfaces of at least 3 minutes, and wherein step (a) is conducted with said cleaning solution at a temperature of at least 30° C.; then (b) exhausting the cleaning solution from said laundering surfaces; and (c) rinsing the laundry surfaces with an aqueous solution comprising less than 200 ppm of said halogen-based oxidant; wherein the laundry trommel of said washing device is oriented in a non-vertical alignment.

In accordance with another aspect of the present invention is provided a process where said halogen-based oxidant is chosen from the group consisting of hypochlorous acid, alkali metal and alkaline metal earth salts of hypochlorite, alkali metal and alkaline metal earth salts of hypobromite, chlorine dioxide, and mixtures thereof; wherein the alkali metal and alkaline metal earth salts include calcium, sodium, potassium, lithium, magnesium, and combinations thereof.

In accordance with another aspect of the present invention is provided a process wherein the alkaline builder is an alkali metal or alkaline metal earth salt wherein said alkali metal cation or alkaline metal cation of said builder is the same species of cation as the cation of said halogen-based oxidant.

In accordance with another aspect of the present invention is provided a process wherein said cleaning solution is formed by introduction of a dosing composition by a dosing means, wherein said dosing composition comprises: a halogen-based oxidant; an alkaline builder; and a halogen stable surfactant; wherein said dosing means comprises at least one dosing device associated with said washing machine and capable of forming said cleaning solution by dispensing of the dosing composition within a wash cycle of the washing machine during operation.

In accordance with another aspect of the present invention is provide a process employing a dosing composition comprising a halogen-based oxidant at a level sufficient to achieve a cleaning solution level of oxidant between about 200 to 2500 ppm; an effective level of an alkaline builder selected from the group consisting of silicates, phosphates, carbonates, and mixtures thereof; wherein said effective level of said alkaline builder is that capable of reducing the effects of corrosion of said halogen-based oxidant on said laundering surfaces; and less than 200 ppm of a halogen stable surfactant; and a halogen stable water soluble and/or water dispersible polymer capable of reducing the effects of corrosion of said halogen-based oxidant on said laundering surfaces; optionally, a bleach stable colorant imparting a visible color to said treatment composition wherein the combination of the alkaline builder and the polymer is capable of reducing the effects of corrosion of said halogen-based oxidant on said laundering surfaces and simultaneously reducing the level of biofilm on said laundering surfaces, wherein said reduction of the effect of corrosion is greater than in the absence of said polymer; and wherein said colorant serves as a visual indicator characteristic to said treatment composition with said color serving as a visual aid to not add fabrics to the washing machine during said fabric free cycle of the laundry wash cycle.

In accordance with another aspect of the present invention is provided a process wherein said dosing device is one or more, or any combination of a dosing tray associated with said washing machine capable of dispensing an additive from the dosing tray to the inside of the washing machine during operation.

In accordance with another aspect of the present invention is provided a process wherein said dosing device is an independent dosing device that may be placed inside the main washing chamber of said washing machine prior to starting a wash cycle; wherein said independent dosing device is capable of forming said cleaning solution upon introduction of water into the washing chamber of said washing device.

In accordance with another aspect of the present invention is provided a process wherein said dosing composition comprises a halogen-based oxidant at a level sufficient to achieve a cleaning solution level of oxidant between about 200 to 2500 ppm; an effective level of an alkaline builder selected from the group consisting of silicates, phosphates, carbonates, and mixtures thereof; wherein said effective level of said alkaline builder is that capable of reducing the effects of corrosion of said halogen-based oxidant on said laundering surfaces; and less than 200 ppm of a halogen stable surfactant; optionally, a halogen stable water soluble and/or water dispersible polymer capable of reducing the effects of corrosion of said halogen-based oxidant on said laundering surfaces.

In accordance with another aspect of the present invention is provided process wherein said surfactant is selected from the group consisting of amine oxides, carboxybetaines, sulfobetaines, alkyl sulfates, alkyl sulfonates, alkylene sulfonates, aryl sulfonates, alkylaryl sulfonates, fatty acid soaps, and combinations thereof. In accordance with another aspect of the present invention is provided a process wherein said polymer comprises a copolymer having between 10 moles to 90 moles of styrene monomer, or derivative thereof, in combination with a an acrylic acid monomer, or derivative thereof.

In accordance with another aspect of the present invention is provided a process wherein said combination of halogen-based oxidant, alkaline builder and halogen stable surfactant is introduced into said dosing device in a form selected from a liquid, liquid-gel, encapsulated liquid, encapsulated liquid-gel, particulate, solid, solid-gel, tablet or mixture thereof.

In accordance with another aspect of the present invention, the dosing and resulting treatment compositions used according to the methods described herein deliver a halogen-based oxidant cleaning solution with effective levels of adjuncts to contact the internal laundering surfaces of a washing machine during a treatment cycle in which no fabrics are present in the laundry drum of the machine in order to effect remediation of microfloral propagation and biofilm development during a fabric free treatment cycle of the laundry wash cycle for maximum effectiveness of the compositions of the present invention.

In accordance with another aspect of the present invention is provided a process in which the cleaning solution is exposed to the surfaces being treated for at least 5 minutes. In accordance with another aspect of the present invention is provided a process in which the oxidatively-sensitive device components retain at least 75% of their desired mechanical properties after 3000 washing cycles of operation.

In accordance with yet another aspect of the present invention is provided a treatment composition for addition to a fabric free cycle of a laundry wash cycle for remediation of microfloral propagation and biofilm development on internal laundering surfaces of a washing machine that are oxidatively sensitive, comprising: 2 to 15 weight % of a halogen-based; 0.05 to 5 weight % of an alkaline builder selected from the group consisting of silicates, phosphates, carbonates, and mixtures thereof; and 0.01 to 2.5 weight % of a halogen stable surfactant; 0.01 to 2.5 weight % of a halogen stable water soluble and/or water dispersible polymer; wherein the combination of the alkaline builder and the polymer is capable of reducing the effects of corrosion of said halogen-based oxidant on said laundering surfaces and simultaneously reducing the level of biofilm on said laundering surfaces, wherein said reduction of the effect of corrosion is greater than in the absence of said polymer.

In accordance with another aspect of the present invention is provided a treatment composition further including a bleach stable colorant imparting a visible color to said treatment composition; wherein said colorant serves as a visual indicator characteristic to said treatment composition with said color serving as a visual aid to not add fabrics to the washing machine during the fabric free treatment cycle of the laundry wash cycle.

In accordance with another aspect of the present invention is provided a treatment composition wherein said polymer comprises a copolymer having between 10 moles to 90 moles of styrene monomer, or derivative thereof, in combination with a an acrylic acid monomer, or derivative thereof. In accordance with another aspect of the present invention is provided a treatment composition wherein said copolymer has a molecular weight between 1500 and 5,000,000 Daltons.

In accordance with another aspect of the present invention is provided a treatment composition wherein said reduction of the effects of corrosion are obtained by producing a Corrosion Score of less than 1.0 after exposing an aluminum test coupon to a cleaning solution formed by dilution of 3 doses of said treatment composition diluted into 25 liters of tap water for at least 12 hours at a temperature of at least 25° C.

In accordance with yet another aspect of the present invention is provided a treatment composition wherein said reduction of the level of biofilm are obtained by producing a Biofilm Reduction Score that is greater or equal to 80%.

In accordance with another aspect of the present invention is provided a treatment composition for remediation of microfloral propagation and biofilm development on internal laundering surfaces of a washing machine that are oxidatively sensitive, comprising: 2 to 15 weight % of a halogen-based oxidant; 0.05 to 5 weight % of an alkaline builder selected from the group consisting of silicates, phosphates, carbonates, and mixtures thereof; 0.01 to 2.5 weight % of a halogen stable surfactant; and optionally, 0.01 to 2.5 weight % of a halogen stable water soluble and/or water dispersible polymer; wherein said treatment composition is dosed into a washing machine wherein the laundry trommel is oriented in a non-vertical alignment; wherein a cleaning solution is formed by dilution of said treatment composition with wash water at a sufficient dilution to expose the laundering surfaces, in the absence of fabric and detergent, to a cleaning solution consisting of said halogen-based oxidant at a level between about 200 to 2500 ppm, an effective level of said alkaline builder, and less than 200 ppm of said surfactant; wherein said effective level of alkaline builder is that level sufficient so that the cleaning solution is effective at reducing biofilm on said internal laundering surfaces and the cleaning solution reduces the effects of corrosion of the halogen-based oxidant; wherein said cleaning solution produces a corrosion score of less than 1.0 after exposing an aluminum test coupon to said cleaning solution formed by dilution of 3 dose units of said treatment composition diluted into 25 liters of tap water for at least 12 hours at a temperature of at least 25° C.; wherein said dose unit comprises either 250 milliliters or 250 grams of said treatment composition prior to dilution.

In accordance with another aspect of the present invention is provided a treatment composition wherein said polymer comprises a copolymer having between 10 moles to 90 moles of styrene monomer, or derivative thereof, in combination with a an acrylic acid monomer, or derivative thereof, and wherein said copolymer has a molecular weight between 1500 and 5,000,000 Daltons. Alternatively, in accordance with another aspect of the present invention, a copolymer having 10 moles to 90 moles of styrene monomer, or derivative thereof, in combination with an acidic and/or anionic charge forming water soluble monomer species, may be employed. In yet another aspect of the present invention, the copolymer may have between 20 to 80 moles of styrene monomer, or derivative thereof, present in the polymer, or alternatively between 30 to 70 moles of styrene monomer, or derivative thereof; present in the polymer.

In accordance with another aspect of the present invention is provided a treatment composition wherein said cleaning solution produces a Corrosion Score of less than 0.25 in combination with a Biofilm Reduction Score of at least 60%.

In accordance with yet another aspect of the present invention is provided a treatment kit comprising: A. a dosing composition comprising: 2 to 15 weight % of a halogen-based oxidant; 0.05 to 5 weight % of an alkaline builder selected from the group consisting of silicates, phosphates, carbonates, and mixtures thereof; 0.01 to 2.5 weight % of a halogen stable surfactant; and optionally, 0.01 to 2.5 weight % of a halogen stable water soluble and/or water dispersible polymer; and B. instructions for a method of use comprising the steps of: a. exposing the laundering surfaces, in the absence of fabric and detergent, to a cleaning solution comprising: a halogen-based oxidant at a level between about 200 to 2500 ppm; an effective level of an alkaline builder selected from the group consisting of silicates, phosphates, carbonates, and mixtures thereof, wherein said effective level of said alkaline builder is that amount capable of reducing the effects of corrosion of said halogen-based oxidant on said laundering surfaces; and less than 200 ppm of a halogen stable surfactant; wherein step (a) provides a contact duration of the cleaning solution with said laundry surfaces of at least 3 minutes, and wherein step (a) is conducted with said cleaning solution at a temperature of at least 30° C.; exhausting the cleaning solution from said laundering surfaces; and rinsing the laundry surfaces with an aqueous solution comprising less than 200 ppm of said halogen-based oxidant; wherein the laundry trommel of said washing device is oriented in a non-vertical alignment; wherein said treatment composition is dosed into a washing machine wherein the laundry trommel is oriented in a non-vertical alignment; wherein a cleaning solution is formed by dilution of said treatment composition with wash water at a sufficient dilution to expose the laundering surfaces, in the absence of fabric and detergent, to a cleaning solution consisting of said halogen-based oxidant at a level between about 200 to 2500 ppm, an effective level of said alkaline builder, and less than 200 ppm of said surfactant; wherein said effective level of alkaline builder is that level sufficient so that the cleaning solution is effective at reducing biofilm on said internal laundering surfaces and the cleaning solution reduces the effects of corrosion of the halogen-based oxidant; wherein said cleaning solution produces a corrosion score of less than 1.0 after exposing an aluminum test coupon to said cleaning solution formed by dilution of 3 dose units of said treatment composition diluted into 25 liters of tap water for at least 12 hours at a temperature of at least 25° C.; wherein said dose unit comprises either 250 milliliters or 250 grams of said treatment composition prior to dilution.

Further features and advantages of the present invention will become apparent to those of ordinary skill in the art in view of the detailed description of preferred embodiments below, when considered together with the attached drawings and claims.

BRIEF DESCRIPTION OF THE DRAWING

The foregoing aspects and others will be readily appreciated by the skilled artisan from the following description of illustrative embodiments when read in conjunction with the accompanying drawings.

FIG. 1 shows a bleach soaking test on aluminum coupons in which one end of the coupon was soaked for 12 hours in a cleaning solution obtained by diluting the indicated volumes (1 cup is about 250 milliliters) of the indicated test products as shown in Table 2 in about 25 liters of regular tap water.

DETAILED DESCRIPTION

In one embodiment of the present invention is provided a process for remediation of microfloral propagation and biofilm development on internal laundering surfaces of a washing machine that are oxidatively sensitive, comprising the steps of: (a) exposing the laundering surfaces, in the absence of fabric and detergent, to a cleaning solution comprising: a halogen-based oxidant at a level between about 200 to 2500 ppm; an effective level of an alkaline builder selected from the group consisting of silicates, phosphates, carbonates, and mixtures thereof; wherein said effective level of said alkaline builder is that amount capable of reducing the effects of corrosion of said halogen-based oxidant on said laundering surfaces; and less than 200 ppm of a halogen stable surfactant; wherein step (a) provides a contact duration of the cleaning solution with said laundry surfaces of at least 3 minutes, and wherein step (a) is conducted with said cleaning solution at a temperature of at least 30° C.; (b) exhausting the cleaning solution from said laundering surfaces; and (c) rinsing the laundry surfaces with an aqueous solution comprising less than 200 ppm of said halogen-based oxidant; wherein the laundry trommel of said washing device is oriented in a non-vertical alignment.

In another embodiment of the present invention is provided a process where said halogen-based oxidant is chosen from the group consisting of hypochlorous acid, alkali metal and alkaline metal earth salts of hypochlorite, alkali metal and alkaline metal earth salts of hypobromite, chlorine dioxide, and mixtures thereof; wherein the alkali metal and alkaline metal earth salts include calcium, sodium, potassium, lithium, magnesium, and combinations thereof. In accordance with another aspect of the present invention is provided a process according to claim 2, wherein the alkaline builder is an alkali metal or alkaline metal earth salt of the chosen anions of the halogen-based oxidant. In accordance with another aspect of the present invention is provided a process wherein said cleaning solution is formed by introduction of a dosing composition by a dosing means, wherein said dosing composition comprises: a halogen-based oxidant; an alkaline builder; and a halogen stable surfactant; wherein said dosing means comprises at least one dosing device associated with said washing machine and capable of forming said cleaning solution by dispensing of the dosing composition within a wash cycle of the washing machine during operation.

In another embodiment of the present invention is provided process wherein said dosing device is one or more, or any combination of a dosing tray associated with said washing machine capable of dispensing an additive from the dosing tray to the inside of the washing machine during operation.

In accordance with another aspect of the present invention is provided a process wherein said dosing device is an independent dosing device that may be placed inside the main washing chamber of said washing machine prior to starting a wash cycle; wherein said independent dosing device is capable of forming said cleaning solution upon introduction of water into the washing chamber of said washing device.

In another embodiment of the present invention is provided a process wherein said dosing composition comprises a halogen-based oxidant at a level sufficient to achieve a cleaning solution level of oxidant between about 200 to 2500 ppm; an effective level of an alkaline builder selected from the group consisting of silicates, phosphates, carbonates, and mixtures thereof; wherein said effective level of said alkaline builder is that capable of reducing the effects of corrosion of said halogen-based oxidant on said laundering surfaces; and less than 200 ppm of a halogen stable surfactant; optionally, a halogen stable water soluble and/or water dispersible polymer capable of reducing the effects of corrosion of said halogen-based oxidant on said laundering surfaces.

In another embodiment of the present invention is provided process wherein said surfactant is selected from the group consisting of amine oxides, carboxybetaines, sulfobetaines, alkyl sulfates, alkyl sulfonates, alkylene sulfonates, aryl sulfonates, alkylaryl sulfonates, fatty acid soaps, and combinations thereof. In accordance with another aspect of the present invention is provided a process wherein said polymer comprises a copolymer having between 10 moles to 90 moles of styrene monomer, or derivative thereof, in combination with a an acrylic acid monomer, or derivative thereof.

In another embodiment of the present invention is provided a process wherein said combination of halogen-based oxidant, alkaline builder and halogen stable surfactant is introduced into said dosing device in a form selected from a liquid, liquid-gel, encapsulated liquid, encapsulated liquid-gel, particulate, solid, solid-gel, tablet or mixture thereof.

In another embodiment of the present invention is provided a process in which the cleaning solution is exposed to the surfaces being treated for at least 5 minutes. In accordance with another aspect of the present invention is provided a process in which the oxidatively-sensitive device components retain at least 75% of their desired mechanical properties after 3000 washing cycles of operation.

In another embodiment of the present invention is provided a treatment composition for remediation of microfloral propagation and biofilm development on internal laundering surfaces of a washing machine that are oxidatively sensitive, comprising: 2 to 15 weight % of a halogen-based; 0.05 to 5 weight % of an alkaline builder selected from the group consisting of silicates, phosphates, carbonates, and mixtures thereof, and 0.01 to 2.5 weight % of a halogen stable surfactant; 0.01 to 2.5 weight % of a halogen stable water soluble and/or water dispersible polymer; wherein the combination of (b) alkaline builder and (d) polymer is capable of reducing the effects of corrosion of said halogen-based oxidant on said laundering surfaces and simultaneously reducing the level of biofilm on said laundering surfaces, wherein said reduction of the effect of corrosion is greater than in the absence of said polymer.

In another embodiment of the present invention is provided a treatment composition wherein said polymer comprises a copolymer having between 10 moles to 90 moles of styrene monomer, or derivative thereof, in combination with a an acrylic acid monomer, or derivative thereof. Alternatively, in another embodiment of the present invention, a copolymer having 10 moles to 90 moles of styrene monomer, or derivative thereof, in combination with an acidic and/or anionic charge forming water soluble monomer species, may be employed. In yet a further embodiment, the copolymer may have between 20 to 80 moles of styrene monomer, or derivative thereof, present in the polymer, or alternatively between 30 to 70 moles of styrene monomer, or derivative thereof. In accordance with another aspect of the present invention is provided a treatment composition wherein said copolymer has a molecular weight between 1500 and 5,000,000 Daltons.

In another embodiment of the present invention is provided a treatment composition wherein said reduction of the effects of corrosion are obtained by producing a Corrosion Score of less than 1.0 after exposing an aluminum test coupon to a cleaning solution formed by dilution of 3 doses of said treatment composition diluted into 25 liters of tap water for at least 12 hours at a temperature of at least 25° C.

In another embodiment of the present invention is provided a treatment composition wherein said reduction of the level of biofilm are obtained by producing a Biofilm Reduction Score that is greater or equal to 80%.

In another embodiment of the present invention is provided a treatment composition for remediation of microfloral propagation and biofilm development on internal laundering surfaces of a washing machine that are oxidatively sensitive, comprising: 2 to 15 weight % of a halogen-based oxidant; 0.05 to 5 weight % of an alkaline builder selected from the group consisting of silicates, phosphates, carbonates, and mixtures thereof; 0.01 to 2.5 weight % of a halogen stable surfactant; and optionally, 0.01 to 2.5 weight % of a halogen stable water soluble and/or water dispersible polymer; wherein said treatment composition is dosed into a washing machine wherein the laundry trommel is oriented in a non-vertical alignment; wherein a cleaning solution is formed by dilution of said treatment composition with wash water at a sufficient dilution to expose the laundering surfaces, in the absence of fabric and detergent, to a cleaning solution consisting of said halogen-based oxidant at a level between about 200 to 2500 ppm, an effective level of said alkaline builder, and less than 200 ppm of said surfactant; wherein said effective level of alkaline builder is that level sufficient so that the cleaning solution is effective at reducing biofilm on said internal laundering surfaces and the cleaning solution reduces the effects of corrosion of the halogen-based oxidant; wherein said cleaning solution produces a corrosion score of less than 1.0 after exposing an aluminum test coupon to said cleaning solution formed by dilution of 3 dose units of said treatment composition diluted into 25 liters of tap water for at least 12 hours at a temperature of at least 25° C.; wherein said dose unit comprises either 250 milliliters or 250 grams of said treatment composition prior to dilution.

In another embodiment of the present invention is provided a treatment composition wherein said polymer comprises a copolymer having between 10 moles to 90 moles of styrene monomer, or derivative thereof, in combination with a an acrylic acid monomer, or derivative thereof, and wherein said copolymer has a molecular weight between 1500 and 5,000,000 Daltons. In accordance with another aspect of the present invention is provided a treatment composition wherein said cleaning solution produces a Corrosion Score of less than 0.25 in combination with a Biofilm Reduction Score of at least 60%.

In another embodiment of the present invention is provided a treatment kit comprising A. a dosing composition comprising: 2 to 15 weight % of a halogen-based oxidant; 0.05 to 5 weight % of an alkaline builder selected from the group consisting of silicates, phosphates, carbonates, and mixtures thereof, 0.01 to 2.5 weight % of a halogen stable surfactant; optionally, 0.01 to 2.5 weight % of a halogen stable water soluble and/or water dispersible polymer; and optionally, a bleach stable colorant imparting a visible color to said treatment composition; B. instructions for a method of use comprising the steps of (a) exposing the laundering surfaces, in the absence of fabric and detergent, to a cleaning solution comprising a halogen-based oxidant at a level between about 200 to 2500 ppm; an effective level of an alkaline builder selected from the group consisting of silicates, phosphates, carbonates, and mixtures thereof, wherein said effective level of said alkaline builder is that amount capable of reducing the effects of corrosion of said halogen-based oxidant on said laundering surfaces; and less than 200 ppm of a halogen stable surfactant; wherein step (a) provides a contact duration of the cleaning solution with said laundry surfaces of at least 3 minutes, and wherein step (a) is conducted with said cleaning solution at a temperature of at least 30° C.; exhausting the cleaning solution from said laundering surfaces; and rinsing the laundry surfaces with an aqueous solution comprising less than 200 ppm of said halogen-based oxidant; wherein the laundry trommel of said washing device is oriented in a non-vertical alignment; wherein said dosing composition is dosed into a washing machine wherein the laundry trommel is oriented in a non-vertical alignment; wherein a cleaning solution is formed by dilution of said dosing composition with wash water at a sufficient dilution to expose the laundering surfaces, in the absence of fabric and detergent, to a cleaning solution consisting of said halogen-based oxidant at a level between about 200 to 2500 ppm, an effective level of said alkaline builder, and less than 200 ppm of said surfactant; wherein said effective level of alkaline builder is that level sufficient so that the cleaning solution is effective at reducing biofilm on said internal laundering surfaces and the cleaning solution reduces the effects of corrosion of the halogen-based oxidant; wherein said cleaning solution produces a corrosion score of less than 1.0 after exposing an aluminum test coupon to said cleaning solution formed by dilution of 3 dose units of said dosing composition diluted into 25 liters of tap water for at least 12 hours at a temperature of at least 25° C.; wherein said dose unit comprises either 250 milliliters or 250 grams of said treatment composition prior to dilution; and wherein said colorant serves as a visual indicator characteristic to said treatment composition with said color serving as a visual aid to not add fabrics to the washing machine during said fabric free cycle of the laundry wash cycle.

In yet a further embodiment, the treatment kit of the present invention includes a polymer comprising a copolymer having between 10 moles to 90 moles of styrene monomer, or derivative thereof, in combination with a an acrylic acid monomer, or derivative thereof; and wherein said copolymer has a molecular weight between 1500 and 5,000,000 Daltons.

In an additional embodiment, the treatment kit provides a cleaning solution that produces a Corrosion Score of less than 0.25 in combination with a Biofilm Reduction Score of at least 60%.

In a further embodiment, the dosing, treatment and/or cleaning solutions of the present invention further include the presence of a bleach stable colorant imparting a visible color to the compositions; wherein said colorant serves as a visual indicator characteristic to said treatment composition with said color serving as a visual aid to not add fabrics to the washing machine during the fabric free treatment cycle of the laundry wash cycle.

The embodiments described herein describe examples of treatment compositions, dosing compositions, treatment kits, treatment processes and methods that provide for the remediation of microfloral propagation and biofilm development on internal laundering surfaces of a washing machine that are oxidatively sensitive through means that do not have the corrosion issues of prior art compositions, treatment means and methods employed to date.

These and other objects and advantages of the present invention will become more fully apparent from the following description taken in conjunction with the accompanying drawings.

Halogen Based Oxidant

Suitable halogen based oxidants include the chlorine bleaches including hypochlorite and/or chlorine-based oxidant compositions that yield a hypochlorite species in aqueous solution, the hypochlorite ion being chemically represented by the formula ($OCl^-$). The hypochlorite ion is a strong oxidizing agent and, for this reason, materials which yield this species are considered to be powerful bleaching and/or disinfecting agents capable of killing mold, mildew, bacteria, viruses and other microbial species that exist both freely and in colony form within biofilms. Exemplary useful bleaching compositions which yield a hypochlorite species in aqueous treatment solutions include alkali metal and alkaline earth metal hypochlorites, hypochlorite addition products, chloramines, chlorimines, chloramides, and chlorimides. Specific examples of compounds of this type include lithium hypochlorite, calcium hypochlorite dihydrate, monobasic calcium hypochlorite, dibasic magnesium hypochlorite, chlorinated trisodium phosphate dodecahydrate, potassium dichloroisocyanurate, trichlorocyanuric acid, sodium dichlorosiocyanurate, trichlorocyanuric acid, sodium dichloroisocyanurate, sodium dichloroisocyanurate dihydrate, 1,3-dichloro-5.5-dimethylhydantoin, N-chlorosulfamide, Chloramine T, Dichloramine T, Chloramine B and Dichloramine B. Most preferably, as the hypochlorite bleach constituent, hypochlorites such as alkali metal hypochlorites, as well as hypochlorite precursors are used. Exemplary hypochlorite producing species include halogen bleaches selected from the group consisting of the alkali metal and alkaline earth salts of hypohalite, haloimines, haloimides and haloamides as the hypochlorite bleach constituent are sodium, potassium, lithium and calcium hypochlorites. Particularly preferred is sodium hypochlorite which is effective and widely commercially available.

Dosing and treatment compositions of the present invention typically contain from about 2 to 15 weight % of a halogen-based oxidant, or alternatively from about 2 to 10 weight %, or yet alternatively from about 2 to 8 weight % of a halogen-based oxidant.

Surfactant

Surfactants are added to the treatment compositions of the present invention for the purpose of improved wetting of contact surfaces, as well as for improved cleaning, and improved stability of the cleaning solutions produced using the compositions and methods described herein. Stability in the presence of the hypochlorite component is the basic criterion for selecting the surfactants to be included in the inventive compositions. Generally, a wide variety of surfactants may be sufficiently stable in the presence of hypochlorite bleaches and these include anionic, zwitterionic, cationic, amphoteric and nonionic surfactants. Suitable surfactants are also found amongst certain classes of surfactants including, but not limited to, amine oxides, betaines, sarcosinates, soaps, taurates, alkyl sulphates, alkyl sulphonates, alkyl aryl sulphonates, alkylphenol ether sulphates, alkyl diphenyl oxide sulphonates, alkyl phosphate esters, and the like.

Bleach stable amine oxides suitable for use in the present invention include alkyl di(lower alkyl)amine oxides in which the alkyl group has about 10-20, and preferably 12-18 carbon atoms, and can be straight or branched chain, saturated or unsaturated. The lower alkyl groups include between 1 and 7 carbon atoms. Examples include lauryl, dimethyl amine oxide, myristyl dimethyl amine oxide, and those in which the alkyl group is a mixture of different amine oxide, dimethyl cocoamine oxide, dimethyl(hydrogenated tallow)amine oxide, and myristyl/palmityl dimethyl amine oxide. A further class of useful amine oxides include alkyl di(hydroxy lower alkyl)amine oxides in which the alkyl group has about 10-20, and preferably 12-16 carbon atoms, and can be straight or branched chain, saturated or unsaturated. Examples are bis (2-hydroxyethyl)cocoamine oxide, bis(2-hydroxyethyl)tallowamine oxide; and bis(2-hydroxyethyl)stearylamine oxide. Further useful amine oxides include those which may be characterized as alkylamidopropyl di(lower alkyl)amine oxides in which the alkyl group has about 10-20, and preferably 12-16 carbon atoms, and can be straight or branched chain, saturated or unsaturated. Examples include, but are not limited to, cocoamidopropyl dimethyl amine oxide and tallowamidopropyl dimethyl amine oxide.

Additional useful amine oxides include those which may be referred to as alkylmorpholine oxides in which the alkyl group has about 10-20, and preferably 12-16 carbon atoms, and can be straight or branched chain, saturated or unsaturated.

Bleach-stable anionic surfactants useful in the present invention and which are especially stable in the presence of hypochlorite include water soluble alkali metal alkyl sulphates, alkyl sulphonates and alkylbenzene sulphonates, particularly the sodium salts of those having from 8 to 18 carbon atoms in the alkyl group, and sodium alkyl sarcosinate salts in which the alkyl group is a saturated hydrocarbon chain having from 7 to 17 carbon atoms, and aryl sulphonates. One example of a bleach stable alkyl sulphate is lauryl sulphate. An example of a bleach stable alkyl sulphonate is the secondary alkyl product sold as Hostapur SAS by Hoechst. A suitable bleach stable sarcosinate is sodium lauroyl sarcosinate, sold under the trademark Hamposyl L30. A bleach stable aryl sulphonate is the product sold by Dow Chemical Company under the Dowfax 2A-1 tradename, being principally sodium dodecyl diphenyloxide disulphonate.

Examples of other organic anionic non-soap surfactants include: sodium C10-C18 alkylsulphates such as sodium dodecylsulphate and sodium tallow alcohol sulphate; sodium C10-C18 alkanesulphonates such as sodium hexadecyl-1,1-sulphonate, and sodium C12-C18 alkylbenzenesulphonates such as sodium dodecylbenzenesulphonate. Another suitable example includes sodium xylene sulfonate (SXS) which is widely available commercially. The corresponding alkali metal and alkali earth metal cation salts such as potassium may also be employed as counterions for the anionic bleach stable surfactants employed in the inventive compositions.

Additional examples of bleach stable anionic surfactants include commercially available materials sold under the tradename ALKASURF (Rhone-Poulenc Company, Princeton N.J.) as well as those commercially available under the tradename MONAWET (Mona Industries, Paterson N.J.).

Also suitable are traditional anionic soaps (saturated or partially unsaturated alkyl carboxylates), such as for example, but not limited to, a coconut fatty acid soap. Generally, soaps with alkyl or alkylene chain lengths of between C8 to C18 are suitable for use in the present invention.

Illustrative examples of some nonionic surfactants with suitable bleach stability for use in the present invention include nonionic alkoxylated phenol surfactants and/or alkoxylated alcohol surfactants, which include one or more of those available under the tradename of NEODOL, commercially available from the Shell Oil Company; TERGITOL, commercially available from Union Carbide, and POLYTERGENT, commercially available from the Olin Chemical, and IGEPAL commercially available from the Rhone-Poulenc Company.

Dosing and treatment compositions of the present invention typically contain between 0.01 to 2.5 weight % of a halogen stable surfactant Alkaline Builder The builder employed in the present invention is preferably an alkaline builders, i.e., a material which in aqueous solution will attain a pH of 7-14, preferably 9-12. Examples of inorganic alkaline builders include the alkali metal and ammonium carbonates (including sesquicarbonates and bicarbonates), silicates (including polysilicates and metasilicates), phosphates (including orthophosphates, tripolyphosphates and tetrapyrophosphates), alumino silicates (both natural and synthetic zeolites), and mixtures thereof. Carbonates are especially desirable for use in this invention because of their high alkalinity and effectiveness in sequestering alkali and metal ions which may be present in hard water, as well as their low cost. Sodium carbonate is a very common example of a suitable alkaline builder compound suitable for use in the present invention.

An effective level of an alkaline builder selected from the group consisting of silicates, phosphates, carbonates, and mixtures thereof, is that level of builder present in the treatment composition contacting the inner laundering surfaces of the washing machine capable of reducing the effects of corrosion of said halogen-based oxidant on those laundering surfaces, parts, and/or materials of construction.

Exemplary suitable phosphonate chelating agents for use herein may include alkali metal ethane 1-hydroxy diphosphonates (HEDP), alkylene poly(alkylene phosphonate), as well as amino phosphonate compounds, including amino aminotri (methylene phosphonic acid) (ATMP), nitrilo trimethylene phosphonates (NTP), ethylene diamine tetra methylene phosphonates, and trimethylene thiamine penta methylene phosphonates (DTPMP). The phosphonate compounds may be present either in their acid form or as salts of different cations on some or all of their acid functionalities.

Organic builders are also suitable for use, and are selected from the group consisting of the alkali metal and ammonium sulfosuccinates, polyacrylates, polymaleates, copolymers of acrylic acid and maleic acid or maleic anhydride, nitrilotriacetic acid, ethylenediaminetetraacetic acid, citrates and mixtures thereof.

Polyfunctionally-substituted aromatic chelating agents may also be useful in the compositions herein, as for example described in U.S. Pat. No. 3,812,044 to Connor et al., the contents of which are herein incorporated by reference. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof.

Preferred alkaline builders from a commercial cost perspective and availability include the group consisting of alkaline metal and alkaline earth metal silicates, phosphates and carbonates, and combinations thereof. Dosing and treatment compositions of the present invention typically contain between 0.05 to 5 weight % of an alkaline builder.

Polymer

The present invention optionally includes a halogen stable water soluble and/or water dispersible polymer capable of reducing the effects of corrosion of the halogen-based oxidant on the internal laundering surfaces to be treated for biofilm and microfloral remediation. Suitable polymers include those disclosed in U.S. Pat. No. 5,650,473, Kimpton, et al., which is incorporated by reference herein in its entirety. U.S. Pat. No. 5,650,473 discloses polymers comprising styrene or substituted-styrene and carboxylated monomer that is prepared by a solution polymerization process, comprising first a polymerization step, followed by a neutralization step, and then a distillation step. The polymers are described as have relatively low molecular weights, generally below about 10,000, and can have higher styrene content than has hither been possible. The polymers are reported to have good soil release properties and so to be particularly useful in cleaning compositions for fabric or hard surface cleaning. However, in the present invention, these polymers where surprisingly found to act as anticorrosion agents by exhibiting surface protective properties on aluminum and metal surfaces when present in treatment compositions containing a halogen based oxidant used to remediate biofilm present on the metal surfaces. Without being bound by theory, it is believed that the styrene monomers, or derivatives of styrene monomers present in the (co)polymer exhibit sufficient localized hydrophobicity to promote some degree of surface affinity of the polymer for the exposed surfaces of metal and plastic surfaces typically found in washing machine materials of construction, and such surface affinity being exhibited at least when a cleaning composition according to the present invention is in direct contact with such surfaces. The metal and plastic materials of construction used in washing machines generally have more hydrophobic surfaces in their native state, and may become more hydrophobic in character when their surfaces are further contaminated by deposits typically found in closed aqueous environments including corrosive salts, hardness deposits (typically calcium and magnesium carbonates and/or their oxides and/or their hydroxides and/or hydrated species thereof), metal oxides (such as aluminum oxide) as well as soil, mineral and fatty deposits present from the cumulative build-up of residue from soiled wash loads present in the washing machine prior to treatment according to the present invention.

Other suitable polymers include those disclosed in pending U.S. Pat. Application 2006/0154088A1, Rodrigues et al., which is incorporated by reference herein in its entirety.

Preferred polymers include copolymers having between 10 moles to 90 moles of at least one styrene monomer, or a monomer being a derivative of styrene, or combination thereof. Also suitable are copolymers having between 20 to 80 moles of at least one styrene monomer, or derivative thereof; or alternatively having between 30 to 70 moles of at least one styrene monomer, or derivative thereof. Preferred copolymers include those that contain, in addition to at least 10 moles of a styrene monomer, or derivative thereof, at least 10 moles of acidic and/or anionic charge forming water soluble monomer species. Examples of suitable acidic and/or anionic charge forming water soluble monomers are disclosed in disclosed in pending U.S. Pat. Application 2006/0154088A1, Rodrigues et al. Suitable copolymers include for example, but not limited to, those polymers composed of styrene and acrylic acidic monomers having at least 10 moles of a styrene monomer, or derivative thereof.

Also suitable are colored polymers including copolymers that have entrained or precipitated coloring agents associated with the polymers during at least one stage of the polymerization or formation process forming the copolymer, as disclosed in copending U.S. patent application Ser. No. 12/013,576 filed on Jan. 14, 2008 by Griffith, et al., which is hereby incorporated by reference in its entirety.

When present, between 0.01 to 2.5 weight % of a halogen stable water soluble and/or water dispersible polymer is effective to act as an anticorrosive agent in the inventive compositions described herein.

Coloring Agent

A coloring agent capable of imparting a visual color to the treatment or dosage compositions of the present invention is a desirable, however optional, ingredient. When present, a coloring agent acts as a visual reminder not to use the treatment composition in the presence of textiles or clothing, or in other words, to employ the treatment compositions of the present invention in a fabric free wash cycle to maximize the effectiveness of the treatment process and/or treatment kit and/or treatment compositions to effect remediation of microfloral and biofilm development within the laundering device thus treated by the means and compositions described herein.

Any substantially water soluble and/or water dispersible dye, pigment, encapsulated dye or pigment, nanoparticulate mineral dye or the like known in the art that is capable of imparting a visual color perceivable by the human eye to compositions of the present invention would be acceptable for use in a fabric free wash cycle according to the methods of the present invention disclosed herein. Preferred are those coloring agents which would not permanently stain a fabric if inadvertently contacted with a fabric either through direct contact with a treatment or dosing composition, or alternatively through a cleaning composition present in the washing machine. Most preferred are those coloring agents which would be completely rinsed free of any fabric contacted with a treatment composition containing the coloring agent through one or more rinse cycles of the treated washing machine in the event of the fabric being present during any one or any combination of process steps done during the process of remediation of microfloral propagation and biofilm development in a washing machine.

When present, any amount of coloring agent sufficient to impart a visual color to the treatment compositions is sufficient, typically between 0.001 to about 2 weight %.

Test Compositions

Compositions representative of some embodiments of the invention are shown in Table 1.

TABLE 1

| Ingredient | Composition 1 | 2 | 3 | 4 | 5 | 6 | 7 | 8 | 9 | 10 |
|---|---|---|---|---|---|---|---|---|---|---|
| NaOCl (1) | 6.0 | 6.0 | 6.0 | 2.2 | 2.2 | 6.0 | 6.0 | 7.2 | 7.2 | 15 |
| NaOH | 0.7 | 0.7 | 0.7 | 0.9 | 0.9 | 0.5 | 0.5 | 0.5 | 0.5 | 1.0 |
| NaCl | 5.5 | 5.5 | 5.5 | | | 5.5 | 5.5 | 6.6 | 6.6 | 13.8 |
| $Na_2CO_3$ | 0.1 | 0.1 | 0.1 | | | 0.1 | 0.1 | 0.15 | 0.15 | 0.25 |
| Na $HCO_3$ | | | | | | | | | | 0.10 |
| $Na_2SiO_3$ (2) | 0.665 | 0.165 | 0.165 | | 0.5 | 0.5 | 0.75 | 1.0 | 1.0 | 1.0 |
| Polymer A (3) | | | 0.50 | | | | | | | |
| Polymer B (4) | | | | 1.0 | 1.0 | | 0.5 | | 1.0 | 1.0 |
| $Na_3(PO_4)_3$ | | | | | | | | | | 1.0 |
| SXS (5) | 0.3 | 0.3 | 0.3 | | | | | | | 0.3 |
| Betaine (6) | 0.3 | 0.3 | 0.3 | | | | | | | 0.3 |
| Amine Oxide (7) | | | | 0.9 | 0.9 | | 0.9 | | | |
| Soap (8) | | | | 0.6 | 0.6 | | 0.6 | | | |
| Water (9) (to 100% | q.s. | q.s. | q.s. | q.s. | q.s. | q.s. | q.s. | q.s. | q.s. | q.s. |

(1) Sodium hypochlorite produced by chlorine infusion at initial stock level of 7.2 weight %. Other sodium salts and builders from generic commercial source.
(2) Sodium silicate, from PQ Corporation
(3) 50:50 polyacrylate:styrene copolymer from Alco Corporation
(4) Copolymer opacifier from Alco based on acrylic acid and styrene monomers (10:90 polyacrylate:styrene monomer ratio)
(5) Sodium xylene sulfonate
(6) Cetyl dimethyl betaine surfactant
(7) Alkyl nominal C12 carboxybetaine surfactant
(8) Soap of a coconut fatty acid
(9) Purified water with low metal ion content.

Test results of several controls, including tap water and a commercially available liquid bleach are shown in Tables 2 and 3, compared to embodiments of the inventive compositions.

TABLE 2

| Test Product | Dosage (Cup) | Coupon | Description (4) |
|---|---|---|---|
| Water (1) | — | A | No change - No corrosion |
| Regular Clorox ™ Bleach (2) | 1 | B | Slight corrosion |
| Regular Clorox ™ Bleach | 2 | C | Moderate corrosion |
| Regular Clorox ™ Bleach | 3 | D | Severe corrosion |
| Regular Clorox ™ Bleach | 6 | E | Very severe corrosion |
| Composition 2 (3) | 1 | F | Some discoloration - very slight corrosion |
| Composition 2 | 3 | G | Medium discoloration - very slight corrosion |
| Composition 1 | 3 | H | Very slight discoloration - no corrosion |

(1) Tap water
(2) Commercial bleach product. The Clorox Company. Label claims 5.5% sodium hypochlorite.
(3) Compositions according to Table 1.
(4) Photographs of coupons corresponding to test product treated correspond to those shown in FIG. 1. Immersion of one side of coupon in the test product diluted into 25 liters of water was maintained for 12 hours at approximately room temperate (25° C.) conditions. Coupons were then removed, rinsed with fresh tap water and allowed to dry overnight before visual evaluations and photographs were taken.

TABLE 3

| Test Product | Dosage (Cup) (3) | Corrosion Score (4) | Biofilm Reduction Score (5) |
|---|---|---|---|
| Regular Clorox ™ Bleach (1) | 1 | 1.00 | <60% |
| Regular Clorox ™ Bleach | 3 | 3.00 | 60% |

TABLE 3-continued

| Test Product | Dosage (Cup) (3) | Corrosion Score (4) | Biofilm Reduction Score (5) |
|---|---|---|---|
| Composition 1 (2) | 3 | 0.25 | 60% |
| Composition 2 | 3 | 1.00 | 80% |
| Composition 3 | 3 | 1.25 | 90% |
| Composition 4 | 3 | 0.25 | <60% |
| Composition 5 | 3 | 0.25 | <50% |

(1) Commercial bleach product. The Clorox Company. Label claims 5.5% sodium hypochlorite.
(2) Compositions according to Table 1.
(3) Dosage was 1 Cup being about 250 milliliters of test composition diluted in 25 Liters of tap water.
(4) Visual determination on the following scale: 0 = No corrosion, 1 = Very slight corrosion 2 = Slight corrosion, 3 = Some or moderate corrosion, 4 = Severe corrosion, 5 = Very severe corrosion. Average of about 5 visual ratings by panelists ranking unmarked test coupons with reference to a water treated control assigned a score of 0.
(5) Visual determination of amount of biofilm removal from a test surface submerged within a Whirlpool Duet HE Front Loader washing machine.

Results clearly show that embodiments of the present invention are capable of reducing the biofilm on a representative laundering surface with surprisingly reduced corrosion effect compared to commercially available bleaching solutions, even when used at relatively high dosage levels and conditions where corrosion effects would otherwise be expected.

In particular, it was surprisingly noted that in some embodiments employing a combination of an alkaline builder with a copolymer, very little corrosion if at all was seen even after prolonged exposure of susceptible laundering test surfaces, such as an aluminum test coupon, to very high dosage levels of the inventive compositions employing combinations of the two corrosion reducing materials.

This invention has been described herein in considerable detail to provide those skilled in the art with information relevant to apply the novel principles and to construct and use such specialized components as are required. However, it is to be understood that the invention can be carried out by different equipment, materials and devices, and that various modifications, both as to the equipment and operating procedures, can be accomplished without departing from the scope of the invention itself.

We claim:

1. A process for remediation of microfloral propagation and biofilm development on internal laundering surfaces of a washing machine that are oxidatively sensitive, comprising the steps of:

a. exposing the laundering surfaces, in the absence of fabric and detergent, to a cleaning solution comprising:
   i. a halogen-based oxidant at a level between about 200 to 2500 ppm;
   ii. an effective level of an alkaline builder selected from the group consisting of silicates, phosphates, carbonates, and mixtures thereof;
      wherein said effective level of said alkaline builder is that amount capable of reducing the effects of corrosion of said halogen-based oxidant on said laundering surfaces; and
   iii. less than 200 ppm of a halogen stable surfactant;

wherein step (a) provides a contact duration of the cleaning solution with said laundry surfaces of at least 3 minutes, and wherein step (a) is conducted with said cleaning solution at a temperature of at least 30° C.;

b. exhausting the cleaning solution from said laundering surfaces; and c. rinsing the laundry surfaces with an aqueous solution comprising less than 200 ppm of said halogen-based oxidant;

wherein the laundry trommel of said washing device is oriented in a non-vertical alignment.

2. A process according to claim 1, wherein said halogen-based oxidant is chosen from the group consisting of hypochlorous acid, alkali metal and alkaline metal earth salts of hypochlorite, alkali metal and alkaline metal earth salts of hypobromite, chlorine dioxide, and mixtures thereof, wherein the alkali metal and alkaline metal earth salts include calcium, sodium, potassium, lithium, magnesium, and combinations thereof.

3. A process according to claim 2, wherein the alkaline builder is an alkali metal or alkaline metal earth salt wherein said alkali metal cation or alkaline metal cation of said builder is the same species of cation as the cation of said halogen-based oxidant.

4. A process according to claim 1, wherein said cleaning solution is formed by introduction of a dosing composition by a dosing means, wherein said dosing composition comprises:

a. a halogen-based oxidant;

b. an alkaline builder; and c. a halogen stable surfactant;

d. optionally, a halogen stable water soluble and/or water dispersible polymer capable of reducing the effects of corrosion of said halogen-based oxidant on said laundering surfaces;

wherein said dosing means comprises at least one dosing device associated with said washing machine and capable of forming said cleaning solution by dispensing of the dosing composition within a wash cycle of the washing machine during operation.

5. A process according to claim 4, wherein said dosing device is one or more, or any combination of a dosing tray associated with said washing machine capable of dispensing an additive from the dosing tray to the inside of the washing machine during operation.

6. A process according to claim 4, wherein said dosing device is an independent dosing device that may be placed inside the main washing chamber of said washing machine prior to starting a wash cycle; wherein said independent dosing device is capable of forming said cleaning solution upon introduction of water into the washing chamber of said washing device.

7. A process according to claim 4, wherein said dosing composition comprises:

a. a halogen-based oxidant at a level sufficient to achieve a cleaning solution level of oxidant between about 200 to 2500 ppm;

b. an effective level of an alkaline builder selected from the group consisting of silicates, phosphates, carbonates, and mixtures thereof, wherein said effective level of said alkaline builder is that capable of reducing the effects of corrosion of said halogen-based oxidant on said laundering surfaces; and c. less than 200 ppm of a halogen stable surfactant; and d. a halogen stable water soluble and/or water dispersible polymer capable of reducing the effects of corrosion of said halogen-based oxidant on said laundering surfaces;

e. optionally, a bleach stable colorant imparting a visible color to said treatment composition.

8. A process according to claim 7, wherein said surfactant is selected from the group consisting of amine oxides, carboxybetaines, sulfobetaines, alkyl sulfates, alkyl sulfonates, alkylene sulfonates, aryl sulfonates, alkylaryl sulfonates, fatty acid soaps, and combinations thereof.

9. A process according to claim 7, wherein said polymer comprises a copolymer having between 10 moles to 90 moles of styrene monomer, or derivative thereof, in combination with a an acrylic acid monomer, or derivative thereof.

10. A process according to claim 7, wherein said dosing composition is introduced into said dosing device in a form selected from a liquid, liquid-gel, encapsulated liquid, encapsulated liquid-gel, particulate, solid, solid-gel, tablet or mixture thereof.

11. A process according to claim 1, in which the cleaning solution is exposed to the surfaces being treated for at least 5 minutes.

12. A process according to claim 1, in which the oxidatively-sensitive device components retain at least 75% of their desired mechanical properties after 3000 washing cycles of operation.

* * * * *